US005947321A

United States Patent [19]

Vadney

[11] Patent Number: 5,947,321

[45] Date of Patent: Sep. 7, 1999

[54] VENTED FOOD CONTAINER

[75] Inventor: David J. Vadney, Farmington, N.Y.

[73] Assignee: Tenneco Packaging Inc., Evanston, Ill.

[21] Appl. No.: 09/005,377

[22] Filed: Jan. 9, 1998

[51] Int. Cl.[6] ..... B65D 51/16

[52] U.S. Cl. ..... 220/367.1; 220/913; 220/326

[58] Field of Search ..... 220/367.1, 913, 220/326; 229/120

[56] References Cited

U.S. PATENT DOCUMENTS

| | | | |
|---|---|---|---|
| Re. 29,415 | 9/1977 | Ricobene et al. . | |
| D. 254,776 | 4/1980 | Edwards . | |
| D. 263,798 | 4/1982 | Edwards . | |
| D. 343,576 | 1/1994 | Krupa . | |
| D. 353,327 | 12/1994 | Castner et al. . | |
| D. 361,035 | 8/1995 | Krupa . | |
| D. 361,036 | 8/1995 | Krupa . | |
| D. 363,879 | 11/1995 | Krupa et al. . | |
| 1,926,240 | 9/1933 | Maas . | |
| 2,819,008 | 1/1958 | White et al. | 229/120 X |
| 3,061,139 | 10/1962 | Edwards . | |
| 4,105,152 | 8/1978 | Elward | 229/120 X |
| 4,132,344 | 1/1979 | Jewell . | |
| 4,210,674 | 7/1980 | Mitchell . | |
| 4,253,600 | 3/1981 | Schubert . | |
| 4,882,463 | 11/1989 | Kyougoku et al. . | |
| 4,883,195 | 11/1989 | Ott et al. . | |
| 5,058,803 | 10/1991 | Gulliver | 229/148 |
| 5,310,070 | 5/1994 | Haas et al. | 220/4.24 |
| 5,456,379 | 10/1995 | Krupa et al. . | |
| 5,474,728 | 12/1995 | Castner et al. . | |
| 5,595,769 | 1/1997 | Castner et al. . | |
| 5,693,388 | 12/1997 | Castner et al. . | |
| 5,833,116 | 11/1998 | Guillin | 220/783 |
| 5,839,651 | 11/1998 | Teags et al. | 229/120 X |

OTHER PUBLICATIONS

Description of Prior Art FIG. 1 and FIG. 2—PCOA:835, Prior Art FIGS. 1,2., date unknown.

Description of FIGs. 1A–1D—PCOA:835, date unknown.

FIGs. 1A–1D Drawings; Manufacturer: Unknown; date unknown.

*Primary Examiner*—Stephen K. Cronin

*Attorney, Agent, or Firm*—Arnold White & Durkee

[57] ABSTRACT

A molded foam container having a number of elongated horizontal side vents formed on its upper sidewalls. The container is designed to maintain the quality of food items packaged therein by venting moisture from the container and inhibiting contaminants from entering the container. The container may be stacked without blocking the vents.

18 Claims, 3 Drawing Sheets

VENTED FOOD CONTAINER

FIELD OF THE INVENTION

The present invention relates generally to food containers and, more particularly, to molded polystyrene foam food containers having side vents for releasing moisture from the container.

BACKGROUND OF THE INVENTION

A variety of food service businesses including, for example, fast-food restaurants and delicatessens, are known to employ molded polystyrene foam containers for packaging prepared food items to be carried out by the customer. Although a number of designs have been proposed, such containers generally include a tray and a cover and a latching mechanism which may be manipulated to open and close the container. In many designs, the tray and cover are hinged together, although the tray and cover may be separate parts. One of the advantageous features of such containers is that, upon using the container to package hot food items, the polystyrene foam insulates and helps to preserve the temperature of the enclosed food items. A further benefit associated with the containers is that they seal the food enclosed therein from contaminants and enable the food enclosed therein to be handled and transported with relative ease. This is an especially important feature in fast-food restaurants because it permits quick and efficient processing of multiple food orders. It is a common practice in fast-food restaurants, for example, to stack multiple containers on top of each other for easier transportation of multiple orders.

Typically, however, when sealed polystyrene foam containers are employed to package hot food items, moisture is produced and retained within the container as a result of condensation as the container is cooled. Food items within the container will absorb the moisture and, depending on how long they remain in the container, may become moist, soggy or otherwise unpalatable. Food items that are particularly vulnerable to this phenomenon include, for example, fried chicken, batter-fried fish, french fries or virtually any food with a high moisture content and/or a crispy coating. One approach which has been proposed to remedy this problem is to provide a series of openings or vents on the top of the container which permit the release of moisture from the container. While this approach is an improvement relative to fully-sealed (i.e. non-vented) containers, it is a less than ideal approach because it permits contaminants to enter through the top vents of the container with relative ease. Contaminants are likely to enter a top-vented container, for example, if they are dropped onto the container or if another container having a contaminated bottom surface is stacked on top of the container. In fact, stacking of top-vented containers may not be accomplished at all without blocking the vents of underlying containers and thereby preventing the release of moisture from the underlying containers.

The present invention is directed to a polystyrene foam container which overcomes or at least reduces the effects of one or more of the problems set forth above.

SUMMARY OF THE INVENTION

In accordance with one aspect of the present invention, there is provided a side-vented molded foam container comprising a tray and a cover. The tray consists of a base and a plurality of lower sidewalls and the cover consists of a lid and a plurality of upper sidewalls. The base and lid have generally horizontal orientations and define, respectively, the bottom and top of the container. The lower sidewalls extend upwardly and outwardly from the base, and the upper sidewalls extend downwardly and outwardly from the lid. The upper and lower sidewalls terminate at outer rims which engage with each other upon closure of the container. Side vents comprising elongated horizontal slots are formed on a number of the upper sidewalls. The side vents are adapted to release moisture from the container when hot foods are contained therein. The side vents are oriented at an angle relative to the lid which causes them to have an effective horizontal width less than their actual width so as to inhibit contaminants from entering the container from above.

BRIEF DESCRIPTION OF THE DRAWINGS

The foregoing and other advantages of the invention will become apparent upon reading the following detailed description and upon reference to the drawings in which.

Figure 1:
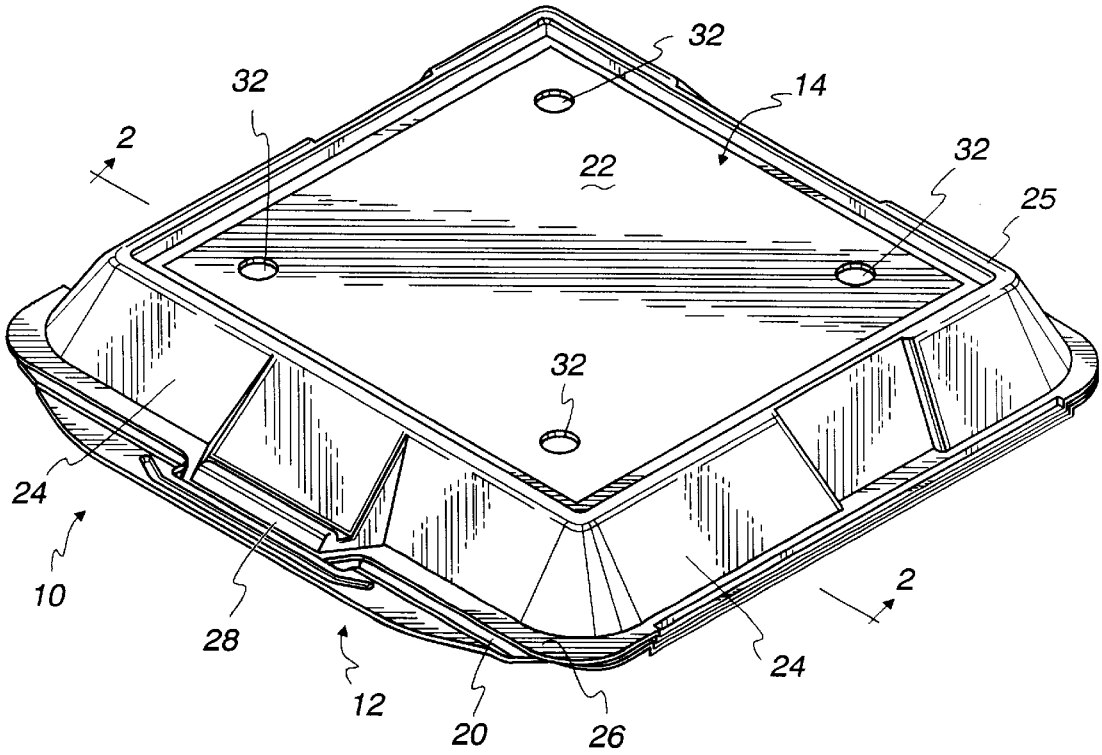
Fig. 1 Prior Art
FIG. 1 is a perspective view of a prior art top-vented polystyrene foam container.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Figure 2:
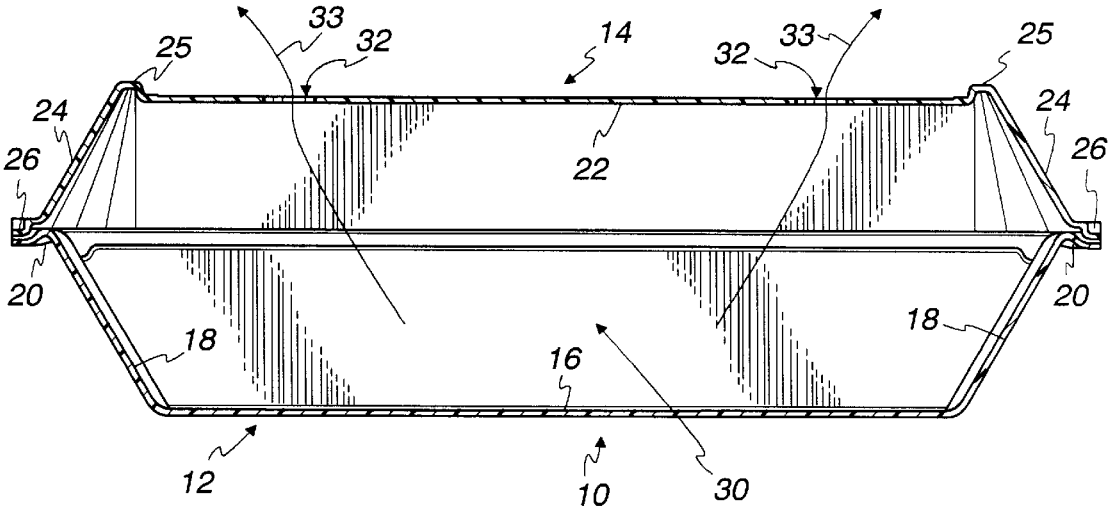
Fig. 2 Prior Art
FIG. 2 is a side sectional view of the prior art top-vented polystyrene foam container of FIG. 1.

Turning now to the drawings and referring initially to FIGS. 1 and 2, there is shown a prior art top-vented polystyrene foam container, designated generally by reference numeral 10. The prior art container 10 consists generally of a tray 12 and a cover 14. As best observed in FIG. 2, the tray 12 includes a horizontal base 16 and a plurality of lower sidewalls 18 extending upwardly and outwardly from the base 16. The lower sidewalls 18 terminate at a flange 20 on the outer perimeter of the tray 12. The cover 14 includes a horizontal lid 22 and a plurality of upper sidewalls 24 extending downwardly and outwardly from the lid 22. The upper sidewalls 24 terminate at a flange 26 on the outer perimeter of cover 14. Flange 20 engages flange 26 when the container 10 is closed, as shown in FIGS. 1 and 2. A latching mechanism 28 may be provided to releasably maintain the container 10 in a closed position. The container 10 may also include a hinge (not shown) connecting the tray 12 and cover 14.

When the container 10 is closed, an enclosed space 30 is defined between the base 16, lid 22, lower sidewalls 18 and upper sidewalls 24. The enclosed space 30 is generally filled with food items (not shown) prior to closing the container 10. When the container 10 is filled with hot food items, moisture usually accumulates in the enclosed space 30 due to condensation. Food items remaining within the container 10 will generally absorb the moisture and, in the case of crispy food items, may lose their crispness. To reduce the amount of moisture accumulating in the container 10, a series of circular vents 32 are formed on the lid 22 of the container 10. Moisiure that would otherwise be trapped within the enclosed space 30 of the container 10 is vented through the vents 32. The venting of moisture from the container 10 is represented graphically in FIGS. 1 and 2 by arrows 33. The vents 32 reduce to some degree the amount and rate at which moisture can be absorbed by food items within the container 10.

Nevertheless, while the vents 32 provide an escape passage for the release of moisture from within the container 10, the vents 32 simultaneously provide an undesired passage in which contaminants (not shown) may enter the container 10 and impair the quality of the food items contained within. In particular, the relatively large size of the vents 32, and their position on the lid 22 of the container 10, make it very likely that contaminants dropped or spilled upon the lid 22 will enter the container 10. Moreover, because the lid 22 has a raised ridge 25 extending around its periphery, contaminants spilled upon the lid 22 that would otherwise spill off the lid 22 will encounter the raised ridge 25 and remain in proximity to the vents 32. Contaminants are also likely to enter the container 10 if other items having contaminated bottom surfaces (such as other containers 10) are stacked on the lid 22 of the container 10. Another problem is that stacking of items on the lid 22 of the prior art container 10 may not be accomplished without blocking and thereby defeating the purpose of the vents 32.

Figure 3:
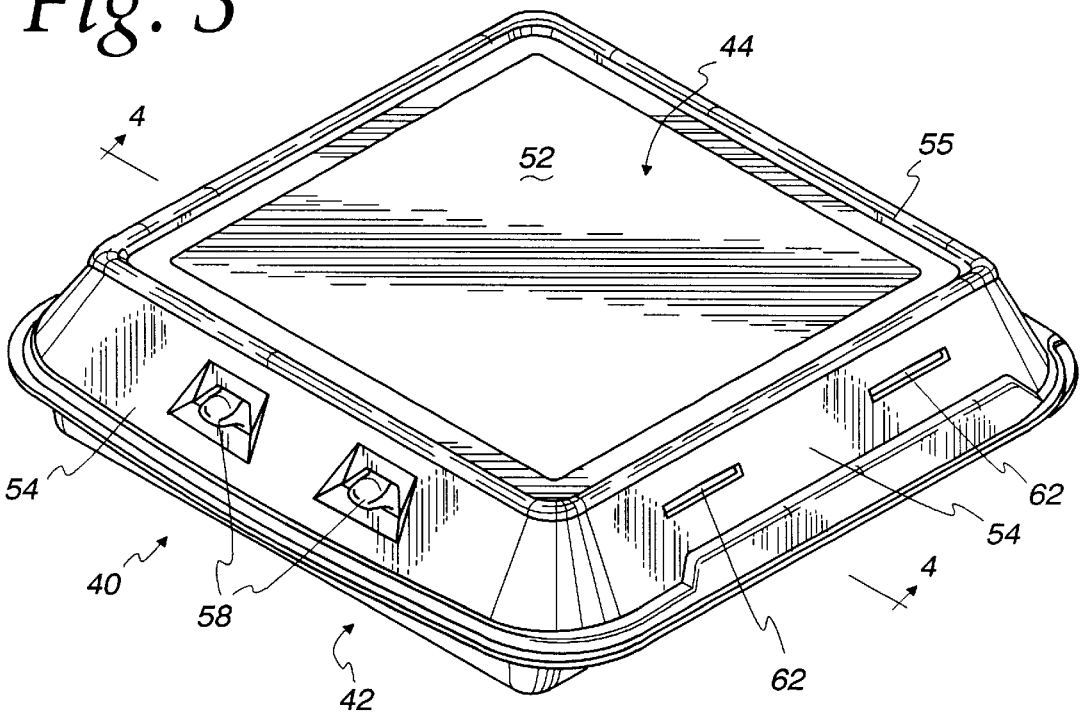
FIG. 3 is a perspective view of a side-vented polystyrene foam container according to one embodiment of the present invention.
Figure 4:
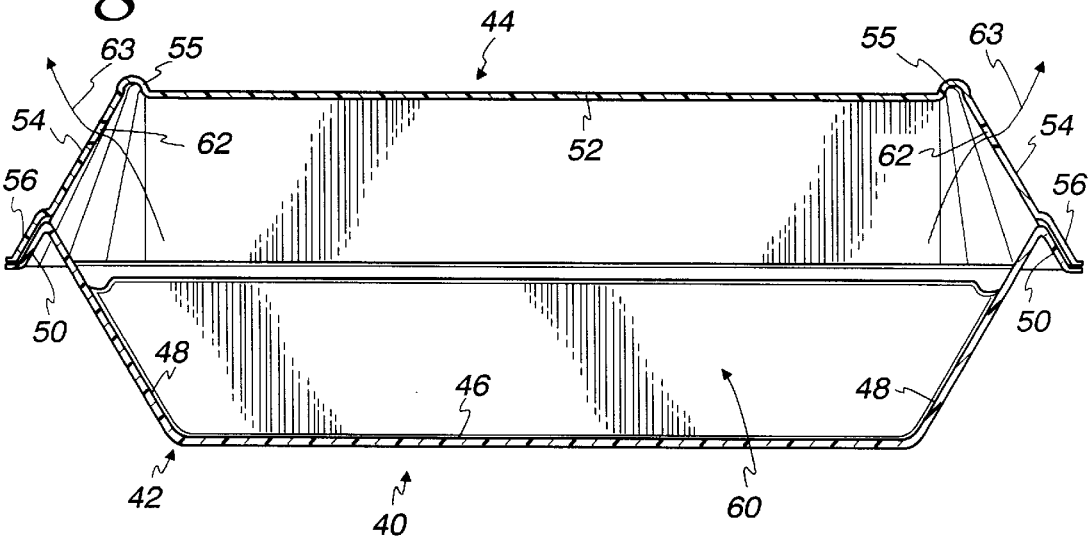
FIG. 4 is a side sectional view of the side-vented polystyrene foam container of FIG. 3.

Referring now to FIGS. 3 and 4, there is shown a side-vented foam container 40 according to one embodiment of the present invention. In one embodiment, the container 40 is constructed of polystyrene foam, although it will be appreciated that the container 40 may be constructed from any of several alternative materials known in the art. The container 40, similar to the prior-art container 10 (FIGS. 1 and 2), consists generally of a tray 42 and a cover 44. As best observed in FIG. 4, the tray 42 includes a horizontal base 46 and a plurality of lower sidewalls 48 extending upwardly and outwardly from the base 46. The lower sidewalls 48 terminate at a flange 50 on the outer perimeter of the tray 42. The cover 44 includes a horizontal lid 52 and a plurality of upper sidewalls 54 extending downwardly and outwardly from the lid 52. In the illustrated embodiment, the base 46 and lid 52 have a generally square configuration, forming a generally box-shaped container 40 with angled sidewalls 48, 54 forming sides of the container 40. It will be appreciated, however, that the container 40 may be formed in a variety of alternative shapes (e.g., polygonal or circular shapes). It will further be appreciated that the sidewalls 48,54 may be formed at virtually any angle relative to the base 46 and lid 52.

The upper sidewalls 54 terminate at a flange 56 on the outer perimeter of cover 44. Flange 50 engages flange 56 when the container 40 is closed, as shown in FIGS. 3 and 4. In the illustrated embodiment, a latching mechanism 58 is provided to releasably maintain the container 40 in a closed position. A hinge (not shown) connects the tray 42 and cover 44 on a side of the container opposite from the latching mechanism 58. It will be appreciated, however, that the container 40 may be provided with alternative latching mechanisms, or the tray 42 and cover 44 may be separate parts (e.g., not connected by a hinge).

When the container 40 is closed, an enclosed space 60 is defined between the base 46, lid 52, lower sidewalls 48 and upper sidewalls 54. The enclosed space 60 is generally filled with food items (not shown) prior to closing the container 40. When the container 40 is filled with hot food items, moisture will tend to accumulate in the enclosed space 60 due to condensation. A plurality of longitudinal vents 62 are formed on the upper sidewalls 54 of the container 40 to vent moisture from the enclosed space 60 of the container 40, thereby reducing the amount and rate at which moisture can be absorbed by foods within the container 40 and preserving the texture, taste and overall quality of the food items.

In the embodiment shown in FIGS. 3 and 4, the container 40 includes two pairs of horizontally-aligned vents 62. Each pair of vents 62 is formed on an opposing upper sidewall 54 of the container 40. It will be appreciated that the number of vents 62 per sidewall 54, the aggregate number of vents 62, the position of the vents 62 on the sidewalls 54 and the size and shape of the vents 62 may be varied to suit particular needs or desires of the customer. The venting of moisture from the container is represented by the arrows 63 in FIGS. 3 and 4. The vents 62 are placed relatively close to the lid 52 to maximize the effectiveness of the venting. It is preferred that the vents 62 have relatively narrow widths relative to the size of the enclosed space 60 so that heat is retained within the food inside and contaminants are inhibited from entering the container 40.

The small size (and in particular the narrow width) of the vents 62 and their position on the angled sidewalls 54 of the container make it unlikely that contaminants dropped or spilled upon the lid 52 (or carried on the bottom surface of other items stacked thereon) will enter the container 40. The lid 52 of the container 40 has a raised ridge 55 extending around its periphery. Like the raised ridge 25 of the prior art container 10, the raised ridge 55 of the container 40 serves as a barrier to contaminants spilled on the lid 52, thus corraling the contaminants to positions on the surface of the lid 52 and inside the ridge 55. However, whereas the presence of contaminants on the lid 22 of the prior art container 10 (in close proximity to its vents 32) increases the likelihood that contaminants will enter the container 10, it is unlikely that contaminants on the lid 52 will enter the container 40. While this is due in part to the small size of the vents 62, it is also due to the position of the vents 62 on the sidewalls 54 of the container 40, because the raised ridge 55 tends to block contaminants from spilling over to the sidewalls 54. The position of the vents 62 on the sidewalls 54 also enables the containers 40 to be stacked without blocking and defeating the purpose of the vents 62.

Figure 5:
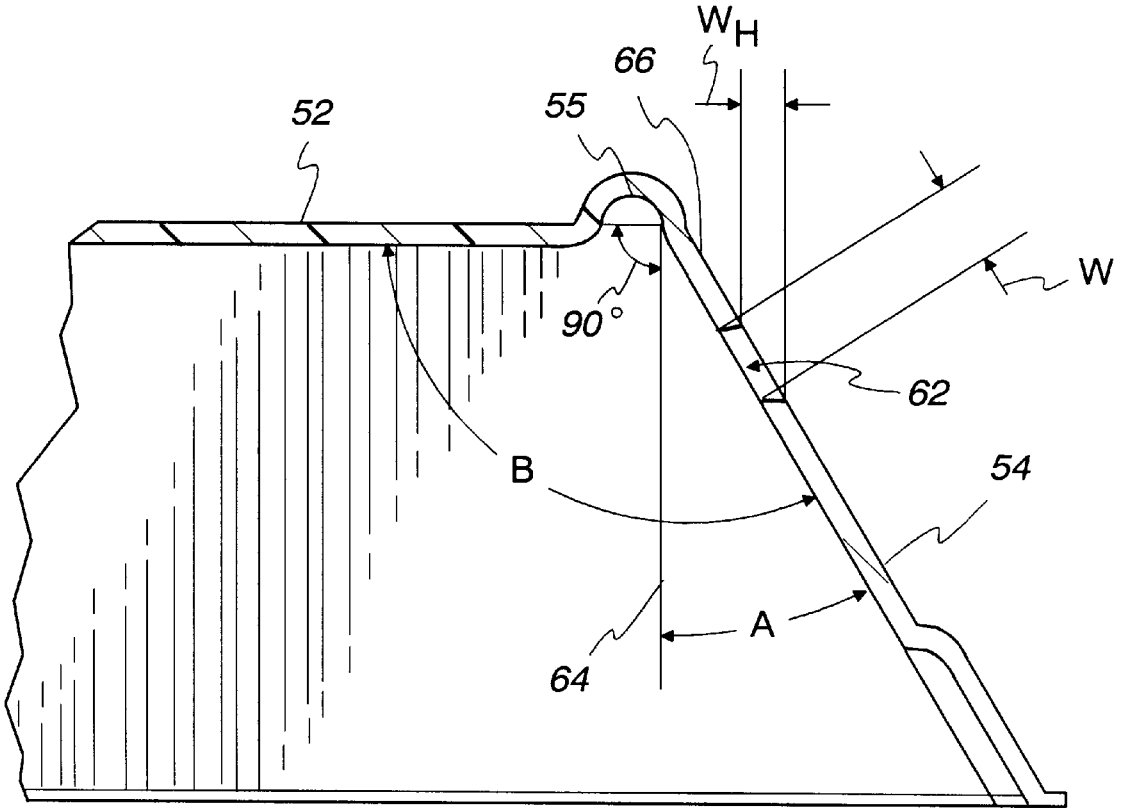
FIG. 5 is an enlarged view of one of the side vents of the polystyrene foam container of FIG. 3.

FIG. 5 illustrates the orientation of an individual vent 62 and sidewall 54 of the container 40 shown in FIGS. 3 and 4. The sidewall 54 is oriented at an angle A relative to a vertical axis 64. The vertical axis 64 is aligned with an outer edge 66 of the lid 52 and is oriented at a 90° angle relative to the lid 52. The sidewall 54 is therefore oriented at an angle B=A+90° relative to the lid 52. The vent 62 has a narrow dimension defining an actual width W oriented along sidewall 54 (and thus oriented at an angle B=A+90° relative to the lid 52). The longer dimension of vent 62 (as best shown in FIG. 3) is oriented parallel to the the lid 52. The angled sidewalls 54 cause the vent 62 to have an effective horizontal width $W_H$ (as viewed from above) which is less than its actual width W. The comparatively small effective horizontal width $W_H$ presents a small opening to contaminants falling vertically (i.e. from above the container 40), thereby reducing the likelihood that the contaminants will enter the container 40. The geometric relationship of the effective horizontal width $W_H$ to the actual width W may be expressed by the equations $W_H = W \sin(A)$ or $W_H = W \sin(B-90°)$. Thus, the extent to which the effective horizontal width $W_H$ is less than the actual width W is dependent on the the orientation of the sidewall 54 (and narrow dimension of the vent 62) relative to the lid 52. It will be appreciated, however, that the effective horizontal width $W_H$ will be less than the actual width W when the angle B defining the orientation of the sidewall 54 to the lid 52 is virtually any angle less than 180°.

In one embodiment, for example, the angle B relative to the lid is greater than 90 degrees and less than about 120 degrees (or, expressed in alternative form, the angle A relative to the vertical axis 64 is between about 0 and 30 degrees), causing the effective horizontal width $W_H$ to have a value of less than about one-half of the value of W. In another embodiment, the angle B relative to the lid is greater than 90 degrees and less than about 130 degrees (or, the angle A relative to the vertical axis 64 is between about 0 and 40 degrees), causing the effective horizontal width $W_H$ to have a value of less than about two-thirds of the value of W. In another embodiment, the angle B relative to the lid is about 120 degrees (or, the angle A relative to the vertical axis 64 is about 30 degrees), causing the effective horizontal width $W_H$ to have a value of about one-half the value of W.

While the present invention may be implemented in a wide variety of different sizes and configurations, one exemplary embodiment of the type shown in FIGS. 3 and 4 will be described in detail. In the exemplary embodiment, the vents 62 are one and one-quarter inch in length and one-eighth inch high, formed on a container 40 which is nine and one-half inches wide by nine inches long by three and one-quarter inch high. The sidewalls 54 are one and one-half inches high. The raised ridge or "corral" 55 on the top of the sidewalls 40 is 0.14" in height. The vents 62 are formed seven-sixteenth of an inch from the corral 55. The sidewalls 54 are oriented at an angle (A) of 25 degrees. The actual width W (FIG. 5) of the vents is one-eighth inch. The effective horizontal width $W_H$ of the vents is W sin(25°)= 0.053 inches, or about one-eighteenth of an inch.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A molded foam container comprising:

a tray including a base and a plurality of lower sidewalls, the base having a generally horizontal orientation, the lower sidewalls being integrally connected to the base and extending upwardly and outwardly therefrom, the lower sidewalls terminating at an outer rim; and a cover including a lid and a plurality of upper sidewalls, the lid having a generally horizontal orientation, the upper sidewalls being integrally connected to the lid and extending downwardly and outwardly therefrom, the upper sidewalls terminating at an outer rim, a number of the upper sidewalls having side vents formed therethrough above the outer rim, the side vents comprising elongated horizontal slots dimensioned to inhibit contaminants from entering the container, the tray and cover being adapted for engagement along their respective outer rims to define an enclosed space within the container, the side vents being adapted to release moisture from the enclosed space when hot foods are packaged within the container.

2. The container of claim 1 further comprising a raised ridge extending about the periphery of the lid, the raised ridge being adapted to inhibit contaminants on the lid from sliding down the upper sidewalls toward the side vents.

3. The container of claim 1 wherein the outer rims of the respective upper and lower sidewalls define generally linear side-sectional shapes.

4. The container of claim 1 wherein the outer rims of the respective upper and lower sidewalls define generally linear edges meeting at corners, the container including a latching mechanism positioned on one or more of said linear edges in regions not including said corners.

5. The container of claim 1 wherein the side vents have a narrow dimension oriented at an angle B relative to the lid and defining an actual width W of the side vents, the side vents having an effective horizontal width $W_H$ less than the actual width W so as to inhibit contaminants from entering the container from above.

6. The container of claim 5 wherein the actual width W is about one-eighth inch.

7. The container of claim 5 wherein the effective horizontal width $W_H$ has a value of W sin(B−90°).

8. The container of claim 7 wherein the angle B relative to the lid is greater than 90 degrees and less than about 130 degrees, the effective horizontal width $W_H$ having a value of less than about two-thirds of the value of W.

9. The container of claim 7 wherein the angle B relative to the lid is about 120 degrees and wherein the effective horizontal width $W_H$ has a value of about one-half the value of W.

10. The container of claim 7 wherein the angle B relative to the lid is greater than 90 degrees and less than about 120 degrees, the effective horizontal width $W_H$ having a value of less than about one-half of the value of W.

11. The container of claim 10 wherein the angle B relative to the lid is about 115 degrees.

12. The container of claim 11 wherein the actual width W is about one-eighth inch and the effective horizontal width $W_H$ is about one-eighteenth of an inch.

13. A molded foam container comprising:

a tray including a base and a plurality of lower sidewalls, the base having a generally horizontal orientation, the lower sidewalls being integrally connected to the base and extending upwardly and outwardly therefrom, the lower sidewalls terminating at an outer rim; and a cover including a lid and a plurality of upper sidewalls, the lid having a generally horizontal orientation, the upper sidewalls being integrally connected to the lid and extending downwardly and outwardly therefrom, the upper sidewalls terminating at an outer rim, a number of the upper sidewalls having side vents formed therethrough, the side vents comprising elongated horizontal slots dimensioned to inhibit contaminants from entering the container, the upper and lower sidewalls each comprising a first and second pair of opposing sidewalls defining a generally rectangular container, the side vents being formed on only the first pair of opposing sidewalls of the upper sidewalls;

the tray and cover being adapted for engagement along their respective outer rims to define an enclosed space within the container, the side vents being adapted to release moisture from the enclosed space when hot foods are packaged within the container.

14. The container of claim 13 wherein each of the first pair of opposing upper sidewalls includes two side vents aligned along a horizontal axis and positioned at generally opposite ends of the associated sidewall.

15. The container of claim 14 wherein the tray and cover comprise a unitary composition of polystyrene foam, the tray and cover being hingedly connected to each other between one of upper and lower sidewalls, the tray cover being releasable latch to each other between a second one of the upper and lower sidewalls.

16. A molded polystyrene foam container comprising:

a tray including a rectangular base and four lower sidewalls, the base having a generally horizontal orientation, the lower sidewalls being integrally connected to the base and extending upwardly and outwardly therefrom, the lower sidewalls terminating at an outer rim; and a cover including a rectangular lid and four upper sidewalls, the lid having a generally horizontal orientation, the upper sidewalls being integrally connected to the lid and extending downwardly and outwardly therefrom, the upper sidewalls terminating at an outer rim, two of the upper sidewalls having a pair of side vents formed therethrough above the outer rim, each of the side vents comprising an elongated horizontal slot dimensioned to inhibit contaminants from entering the container, the side vents having an actual width W oriented at an angle of from about 110 degrees to 130 degrees relative to the lid, the side vents having an effective horizontal width less than about two-thirds the value of W;

the tray and cover being adapted for engagement along their respective outer rims to define an enclosed space, the side vents being adapted to release moisture from the enclosed space when hot foods are packaged within the container.

17. The container of claim 16 wherein the outer rims of the respective upper and lower sidewalls define generally linear side-sectional shapes.

18. The container of claim 16 wherein the outer rims of the respective upper and lower sidewalls define generally linear edges meeting at corners, the container including a latching mechanism positioned on one or more of said linear edges in regions not including said corners.

* * * * *

UNITED STATES PATENT AND TRADEMARK OFFICE

CERTIFICATE OF CORRECTION

PATENT NO.: 5,947,321

DATED: September 7, 1999

INVENTOR(S): Vadney

It is certified that errors appear in the above-identified patent, and that said Letters Patent is hereby corrected as shown below.

Column 7, Claim 15, line 2, after "of" insert --the--.

Column 7, Claim 15, line 2, after "tray" insert --and--.

Column 7, Claim 15, line 3, delete "releasable latch" and insert --releasably latched--.

Signed and Sealed this

Thirtieth Day of May, 2000

*Attest:*

*Attesting Officer*

Q. TODD DICKINSON

*Director of Patents and Trademarks*